US008720576B2

(12) United States Patent
Marlow et al.

(10) Patent No.: US 8,720,576 B2
(45) Date of Patent: May 13, 2014

(54) MOUNTING A MODULE ON AN UNDERWATER STRUCTURE

(75) Inventors: Kevin Marlow, Bristol (GB); Phillip Tarr, Bristol (GB); Steven Lewis Charles Simpson, Bristol (GB); Harry Richard Cove, Celista (CA)

(73) Assignee: Vetco Gray Controls Limited, Nailsea, Bristol (GB)

( * ) Notice: Subject to any disclaimer, the term of this patent is extended or adjusted under 35 U.S.C. 154(b) by 733 days.

(21) Appl. No.: 12/603,946

(22) Filed: Oct. 22, 2009

(65) Prior Publication Data

US 2010/0170678 A1 Jul. 8, 2010

(30) Foreign Application Priority Data

Oct. 23, 2008 (GB) ..... 0819437.5

(51) Int. Cl.
*E21B 41/04* (2006.01)

(52) U.S. Cl.
USPC ..... 166/339; 166/340; 166/341; 166/351; 166/360; 166/368

(58) Field of Classification Search
CPC E21B 33/0355; E21B 33/038; E21B 41/0035
See application file for complete search history.

(56) References Cited

U.S. PATENT DOCUMENTS

2006/0108120 A1* 5/2006 Saucier ..... 166/344

FOREIGN PATENT DOCUMENTS

| | | | | |
|---|---|---|---|---|
| WO | WO92/03634 | A1 | 3/1992 | |
| WO | WO 9203634 | A1 * | 3/1992 | ..... E21B 33/035 |
| WO | WO2006/057995 | A2 | 6/2006 | |
| WO | WO2006/099316 | A1 | 9/2006 | |

OTHER PUBLICATIONS

Search Report under Section 17(5); Jan. 15, 2009; Application GB0819437.5.

* cited by examiner

*Primary Examiner* — James Sayre
(74) *Attorney, Agent, or Firm* — Bracewell & Giuliani LLP

(57) ABSTRACT

A method of mounting a subsea control module (1) on a mounting plate (10) of an underwater tree of a subsea hydrocarbon well comprises lowering the module to the plate and attaching the module to the plate with an adapter (6) between it and the plate and with portions of the module being coupled with portions of the mounting plate.

21 Claims, 6 Drawing Sheets

MOUNTING A MODULE ON AN UNDERWATER STRUCTURE

FIELD OF THE INVENTION

The present invention relates to mounting a module, in particular a subsea control module, on an underwater structure of a subsea hydrocarbon production well, in particular part of an underwater tree of a subsea hydrocarbon production well.

BACKGROUND OF THE INVENTION

A subsea hydrocarbon production well is controlled by a subsea control module (SCM), which is, typically, mounted on a Christmas tree located above the well head. A substantial part of the subsea hydrocarbon production business is maintenance of such wells, that sometimes involves replacement of an SCM, either due to a failure of the original or to meet the need to update the capability of the control system. The cost of manufacture of small quantity SCM replacements to the original design is not only prohibitive but often impractical due to obsolescence. This invention resolves this problem.

It is sometimes necessary, or more cost effective, to replace the SCMs fitted to an old system with more modern versions. The mounting arrangements of the old SCMs are invariably different from the modern designs. Further, different manufacturers have supplied SCMs with different configurations of base plate interfaces, including alignment, hydraulic, electrical and locking features. For example, some SCM base plates are circular and thus totally incompatible with current designs.

SUMMARY OF THE INVENTION

According to the present invention, there is provided a method of mounting a subsea control module on a structure comprising part of an underwater tree of a subsea hydrocarbon well, the method comprising lowering the module to the structure and attaching the module to the structure with an adapter between it and the structure and with portions of the module being coupled with portions of the structure.

Typically, the method is carried out after removal of an existing subsea control module so that the module replaces said existing module.

The module could be lowered with said adapter attached to it or, alternatively, lowered with said adapter attached to said structure.

Typically, said portions of the module and the structure are selected from the group consisting of electrical, hydraulic and optical connections.

By virtue of the use of adapters, both passive (i.e. involving connectors only) and active (i.e. also including sensors, valves or other active devices) to interface current designs of SCMs with older designs, the invention overcomes the problems of obsolescence, and enables the well operator to reap the benefits of cost reductions from larger quantity manufacture, the improved reliability of modern designs and enhanced capability and performance.

By way of example, the invention enables compatibility between old Vetco Gray SCMs with circular base plates and current Vetco Gray designs with square base plates and with the base plates and locking mechanisms of SCMs of Aker Solutions (formerly Aker Kvaerner) and others.

DETAIL DESCRIPTION OF THE INVENTION

Figure 1:
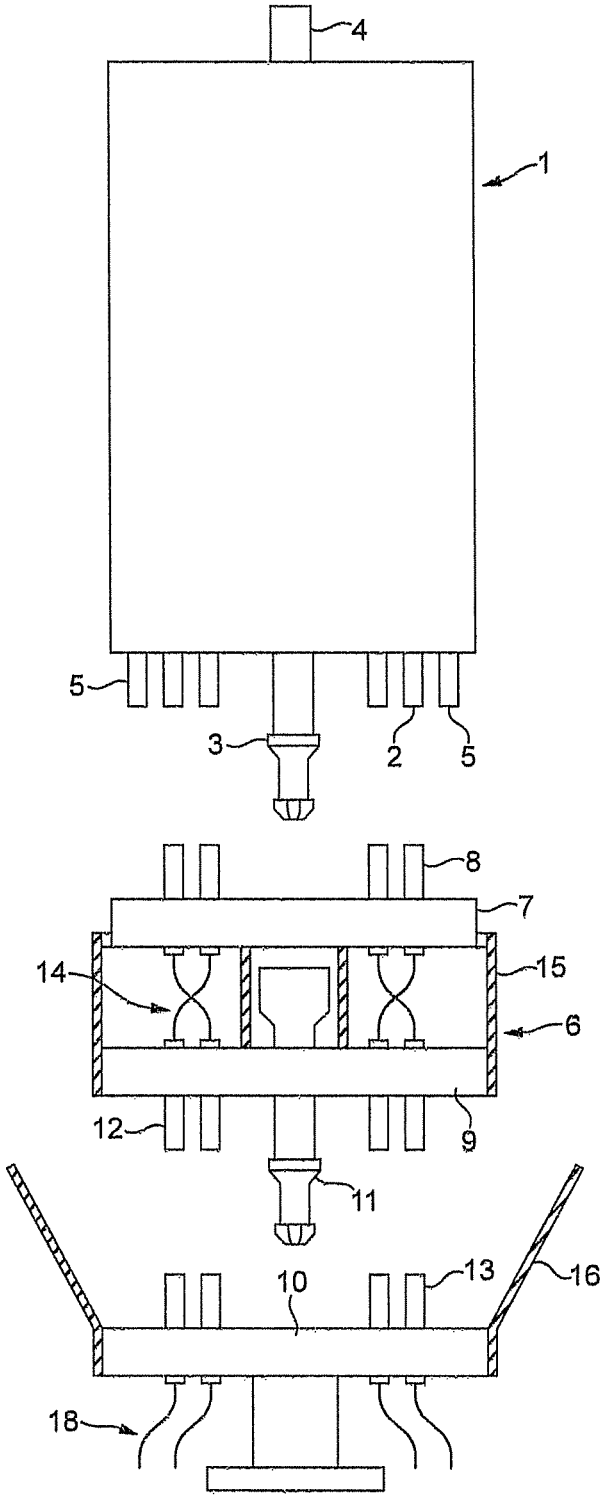
FIG. 1 shows an application of the invention, prior to installation, in a case where the method of locking an SCM is the same as for a modern Vetco Gray SCM (known as Podlock), but the SCM it is to replace is an older version with a different base plate.

FIG. 1 illustrates, diagramatically, prior to installation, a modern SCM 1, with a multiplicity of connectors 2 of various possible types (hydraulic, electrical, optical, etc) mounted on its rectangular base, although for ease of illustration only four are shown. A locking shaft 3 protrudes from the rectangular base of the SCM 1. The tip of the locking shaft 3 has a male tapered cross and is rotated, during installation, typically by a remotely operated vehicle (ROV), from the end of a shaft 4 which protrudes from the top of the SCM 1. The method of locking the SCM 1 to a subsea structure of a hydrocarbon well, in particular a mounting plate on a Christmas tree, is by the location of the male cross on the shaft 3 with a corresponding cross-shaped orifice in the Christmas tree SCM mounting plate and rotating the shaft 4, by typically 45 degrees. Also, on each side, one of a pair of bolting posts 5 is provided on the base of SCM 1.

To fit the SCM 1 to an old system, an adapter 6 is provided. The adapter 6 comprises: a rectangular plate 7, housing corresponding connectors 8 in positions that match those of the SCM 1; a base plate 9, with dimensions that match those of the SCM mounting plate 10 of the Christmas tree to which the SCM is to be fitted; and a locking shaft extension 11. The base plate 9 houses hydraulic and electrical connectors 12, mounted in the required positions to interface with Connectors 13 on the mounting plate 10. The mounting plate 10 originally interfaced with an earlier design of SCM and with connectors in different positions from current SCM designs. Thus, the adapter 6 carries hydraulic pipes and electrical cabling 14, to provide the correct hydraulic and electrical interfacing between the modern SCM 1 and the original SCM mounting plate 10. The adapter is fitted with a shroud 15, shown in sectioned view, to protect the hydraulic and electrical interconnections 14. Since in this case the locking mechanism is the same, the adapter 6 carries shaft 11 through the adapter with a female cross-shaped orifice at the top and a male cross at the bottom so as to provide an extension of the SCM locking shaft 3. The whole adapter arrangement permits the installation of a standard, unmodified SCM.

Figure 2:
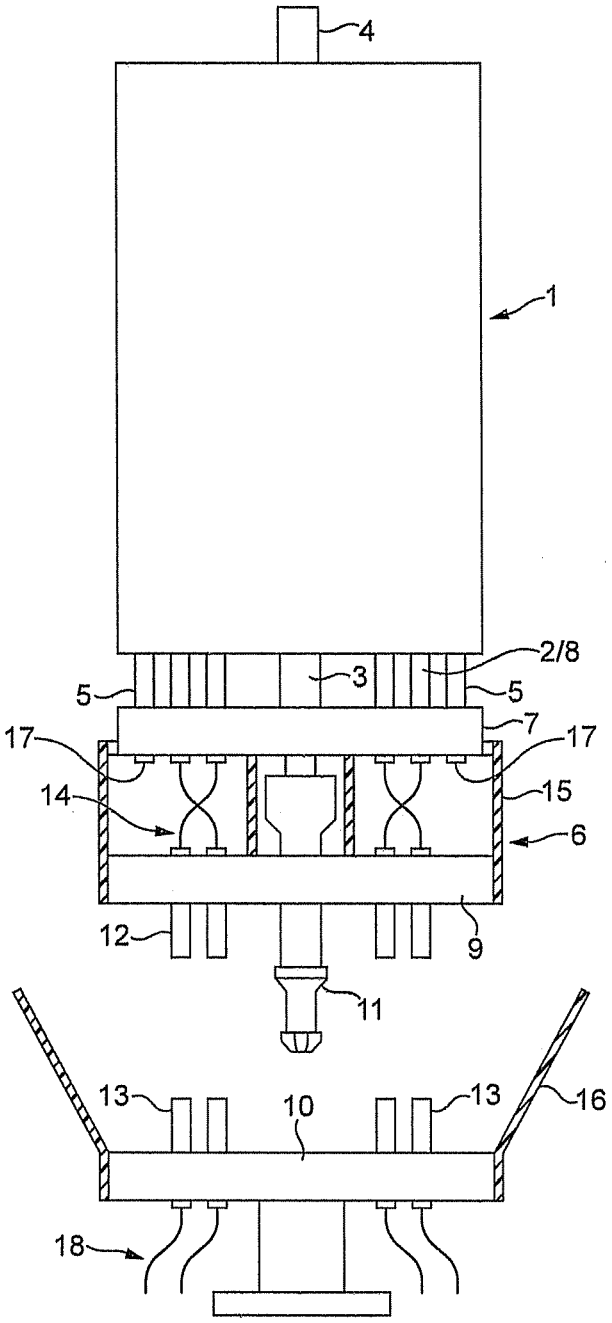
FIG. 2 shows the SCM of FIG. 1 assembled to an adapter.

FIG. 2 shows the first stage of installation, in which the SCM 1 is mated with the adapter 6. The adapter 6 has been bolted to the SCM, 1 to facilitate transportation and installation, by bolts 17 received in posts 5. The adapter 6 is locked to the SCM 1 by locking the extension shaft 11 to shaft 3 by rotation and inserting locking pins, the shaft 3 and extension 11 providing the retention force once installed with the bolting only dealing with handling loads up to this point. Locking the SCM to the adapter allows the complete assembly to be lowered to the seabed, to mate with the mounting plate 10 on the seabed located Christmas tree.

Figure 3:
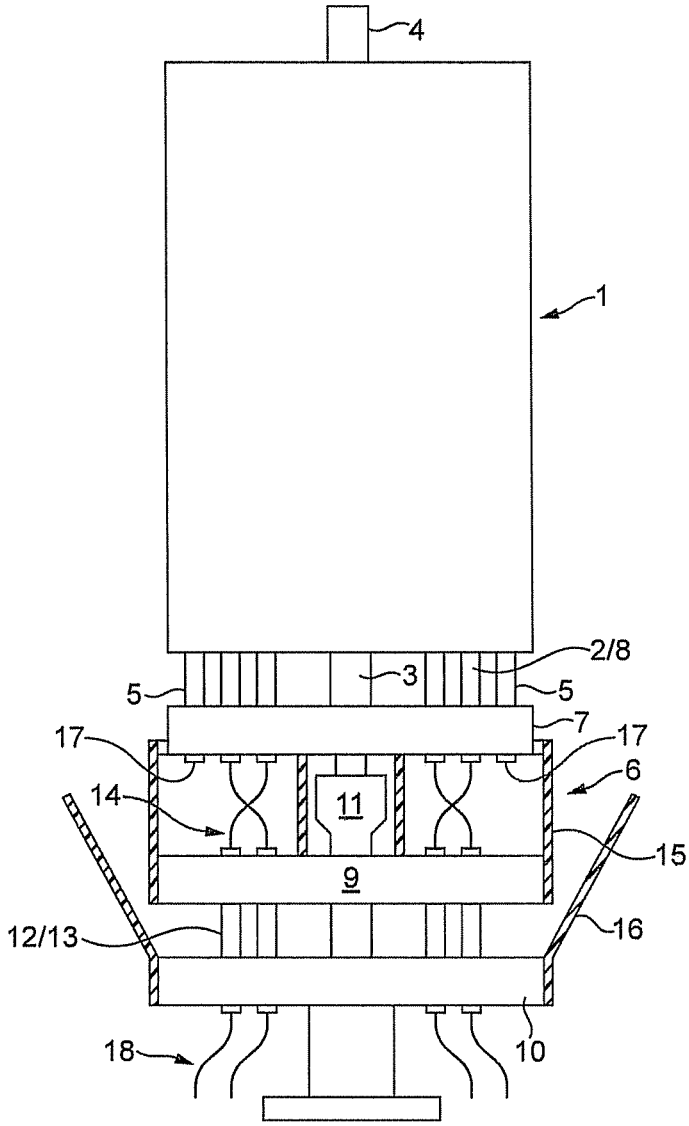
FIG. 3 shows the SCM with the adapter of FIG. 2, installed on a mounting plate of a Christmas tree.

FIG. 3 shows the SCM 1, complete with the adapter 6, mated to the Christmas tree mounting plate 10. Mating is facilitated by a location collar 16. The locking of the whole assembly is achieved, typically by an ROV, by rotating the locking shaft 3 via the shaft 4 at the top of the SCM 1, the rotation being transmitted through the locking shaft extension 11. Reference numeral 18 designates the hydraulic pipes and electrical cabling of plate 10.

Figure 4:
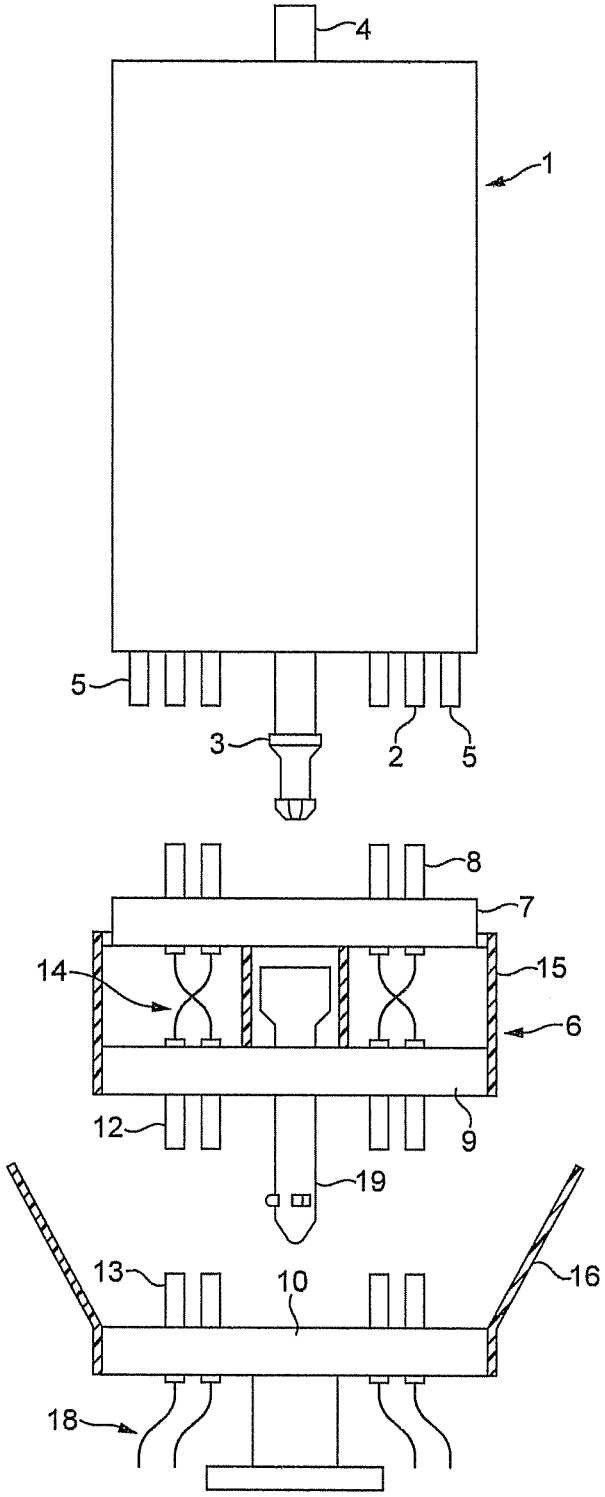
FIG. 4 shows a further case in which the locking method is different from the Vetco Gray standard, with the adapter effecting a conversion.

FIG. 4 illustrates a case where the locking arrangement of the SCM being replaced is different from a modern Vetco Gray SCM, for example the mechanism fitted to a competitor's SCM. The principle of the adapter remains the same as the previous example, the rectangular plate 7 and its connectors 8 interfacing with the modern SCM 1, and the plate 9 with its connectors 12 being configured to match the existing Christmas tree mounting plate 10. In this case, the locking shaft extension is different from the previous example as it adapts the male tapered cross at the tip of the SCM locking shaft 3 to the appropriate locking mechanism of the original SCM, i.e to match the mechanism in the tree mounting plate 10. Thus the extension shaft 19 in the adapter 6 has a female cross-shaped orifice at its top and the appropriate locking interface at the bottom. Again the adapter 6 is bolted to the SCM 1 for handling purposes as described above, the locking shaft 3 and extension shaft 19 providing the clamping force once installed.

There are a number of alternative options for the installation process for the adapter, each of which has advantages and disadvantages.

Referring to FIG. 1, such alternative options include:

a) Dispensing with the locking shaft extension 11 and replacing it with a mechanism to lock the adapter 6 to the mounting plate 10 so that the adapter remains attached at the seabed. This has the advantage that the SCM 1 can be replaced (without the need to disturb the adapter) with a standard modern SCM, i.e. full interchange-ability, but has the disadvantage that the installation process involves two operations and special tooling to lock down the adapter.

b) Bolting the adapter to the SCM for handling as above and dispensing with the locking shaft extension 11 but replacing it with an extended locking shaft 3.

c) Other possible arrangements for attaching the adapter could include the use of modern high power magnets to retain the adapter to the SCM during installation.

d) Replacing the SCM connectors with hydraulic and electrical penetrators. This has the advantage of reducing the number of couplers and connectors, which are expensive, but has the disadvantages that the assembly will not interface with standard SCM test jigs.

The adapter removes the need for expensive engineering design modifications to current SCMs to enable them to replace older designs of SCMs.

The adapter removes the need to redesign an older design of SCM to overcome obsolescence and the resultant low quantity manufacturing costs.

The adapter also enables well operators to take advantage of the improved performance and reliability of a modern SCM when replacing ageing equipment.

The concept also allows well operators to have flexibility of supply contractors to replace existing SCMs since it can be applied to interface any old design of SCM with any new design.

Figure 5:
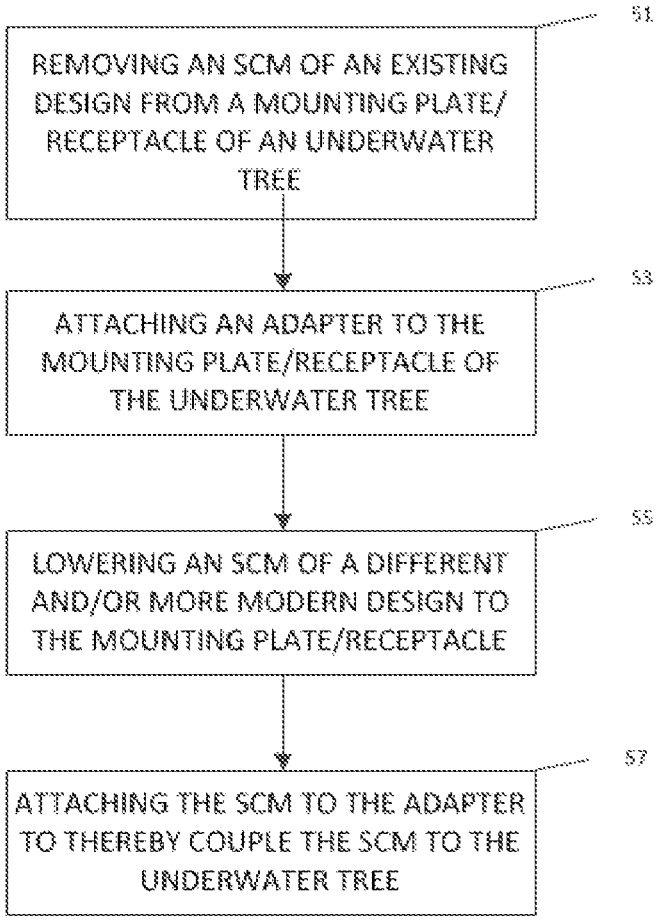
FIG. 5 is a schematic flow diagram illustrating steps for mounting a subsea control module on a structure comprising part of an underwater tree of a subsea hydrocarbon well.

Referring to FIG. 5, according to an embodiment of the present invention, a method of mounting an SCM 1 on a structure comprising part of an underwater tree of a subsea hydrocarbon well can include removing an SCM of an existing design from a mounting plate/receptacle 10 of the underwater tree (block 51) (performed when an SCM of existing design is prior installed), attaching an adapter 6 to the mounting plate/receptacle 10 of the underwater tree (block 53), lowering an SCM 1 of a different and/or more modern design to the mounting plate/receptacle 10 (block 55), and attaching the SCM 1 to the adapter 6 (block 57) to thereby couple the SCM 1 having the different and/or more modem design with the mounting plate/receptacle 10 of the underwater tree.

Figure 6:
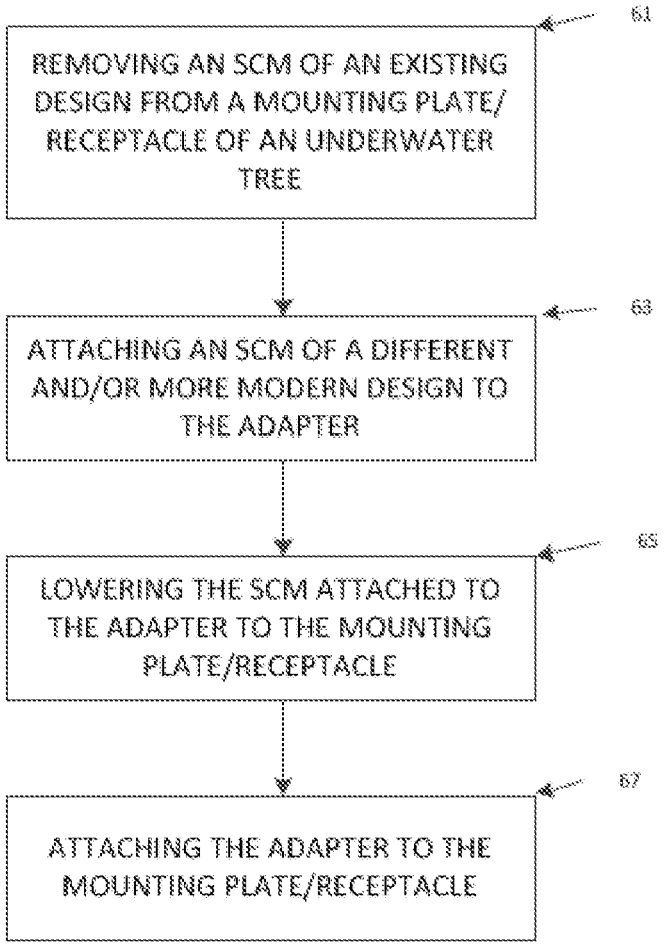
FIG. 6 is a schematic flow diagram illustrating steps for mounting a subsea control module on a structure comprising part of an underwater tree of a subsea hydrocarbon well according to another embodiment.

Referring to FIG. 6, according to another embodiment, the method can include removing an SCM of an existing design from the mounting plate/receptacle 10 (block 61) (performed when an SCM of existing design is prior installed), attaching an SCM 1 of a different and/or more modem design to the adapter 6 configured to couple with both the SCM 1 of the different and/or more modem design and a mounting plate/receptacle 10 of an existing design configuration (block 63), lowering the SCM 1 attached to the adapter 6 to the mounting plate/receptacle 10 (block 65), and attaching the adapter 6 to the mounting plate/receptacle 10 (block 67) to thereby attach the SCM 1 of a different and/or more modern design to the mounting plate/receptacle 10 of the underwater tree.

While this invention has been described and shown in some of its forms, it should be apparent to those skilled in the art that it is not so limited but is susceptible to various changes without departing from the spirit and scope of the invention. In the drawings and specification, there have been disclosed illustrative embodiments of the invention and, although specific terms are employed, they are used in a generic and descriptive sense only and not for the purpose of limitation, the scope of the invention being set forth in the following claims.

The invention claimed is:

1. A method of mounting a subsea control module on a structure comprising part of an underwater tree of a subsea hydrocarbon well, the method comprising:

removing a prior deployed subsea control module ("SCM") directly coupled to a control module mounting structure, the control module mounting structure forming part of an underwater tree of a subsea hydrocarbon well and comprising a mounting plate having a plurality of connectors mounted thereto, the prior deployed SCM having a base, a plurality of connectors mounted to the base according to a first arrangement to interface with the plurality of connectors mounted to the mounting plate of the control module mounting structure, and a locking shaft extending from the base and configured to extend into an orifice in the mounting plate of the control module mounting structure;

lowering a replacement SCM to the structure to replace the prior deployed SCM, the replacement SCM having a base and a plurality of connectors mounted to the base according to a second arrangement, the second arrangement of the plurality of connectors of the replacement SCM being different than the first arrangement of the plurality of connectors of the existing SCM, rendering the replacement SCM incompatible with direct coupling with the control module mounting structure; and attaching the replacement SCM to the control module mounting structure with an adapter positioned between the replacement SCM and the control module mounting structure, the adapter providing for utilization of the replacement SCM to provide for electrical and hydraulic control of the underwater tree, the adapter having a first mounting portion having a plurality of connectors extending therefrom arranged to interface with the plurality of connectors of the replacement SCM, and a second mounting portion having a plurality of connectors extending therefrom arranged to interface with the plurality of connectors mounted to the mounting plate of the control module mounting structure to thereby electrically and hydraulically connect the otherwise incompatible replacement SCM module with the underwater tree via the control module mounting structure.

2. A method as defined in claim 1, wherein the first mounting portion comprises a first mounting plate, wherein the second mounting portion comprises a second mounting plate positioned parallel to and spaced apart from the first mounting plate, and wherein a plurality of electrical and hydraulic fluid interconnections extend therebetween.

3. A method as defined in claim 2, wherein the first mounting plate of the adapter has a smaller cross-section than the second mounting plate of the adapter.

4. A method as defined in claim 2, further comprising:

positioning a shroud around outer surface portions of the first and the second mounting plates to protect the electrical and hydraulic fluid interconnections.

5. A method as defined in claim 1, wherein the adapter further comprises a locking shaft extending from the second mounting portion and configured to extend into the orifice in the mounting plate of the control module mounting structure.

6. a method as defined in claim 5, wherein the replacement SCM includes a locking shaft extending from the base thereof, and wherein the locking shaft of the adapter includes an orifice sized to receive the locking shaft of the replacement SCM.

7. A method as defined in claim 5, wherein the step of attaching the replacement SCM to the control module mounting structure includes:

inserting the locking shaft of the adapter through the orifice of the in the mounting plate of the control module mounting structure; and angularly rotating the locking shaft of the adapter.

8. A method as defined in claim 5, wherein the locking shaft is axially positioned in a center of the replacement SCM along a main longitudinal axis of the replacement SCM when the replacement SCM is operably attached to the adapter.

9. A method as defined in claim 1, wherein the plurality of connectors mounted to the base of the replacement SCM provide electrical, hydraulic fluid and optical connections.

10. A method as defined in claim 1, wherein the replacement SCM when connected to the control module mounting structure with the adapter, provides for performing at least same primary electrical and hydraulic functions as the prior deployed SCM when connected thereto.

11. A method as defined in claim 1, wherein the replacement SCM is lowered with the adapter attached to it.

12. A method as defined in claim 1, wherein the replacement SCM is lowered with the adapter attached to control module mounting structure.

13. A method of mounting a subsea control module on a structure comprising part of an underwater tree of a subsea hydrocarbon well, the method comprising:

lowering a replacement subsea control module ("SCM") to a SCM mounting structure of an underwater tree of a subsea hydrocarbon well, the SCM mounting structure comprising a plurality of connectors extending therefrom and having an arrangement compatible with a previously mounted SCM configured to directly couple with the SCM mounting structure, the replacement SCM having a base and a plurality of connectors mounted to the base according to an arrangement, the arrangement of the plurality of connectors of the replacement SCM being different than an arrangement of a plurality of connectors of the previously mounted SCM, rendering the replacement SCM incompatible with the SCM mounting structure; and attaching the replacement SCM to the SCM mounting structure with an adapter positioned between portions of the replacement SCM and portions of the SCM mounting structure, whereby the portions of the replacement SCM are coupled with the portions of the SCM mounting structure through utilization of the adapter, the adapter providing for utilization of the replacement SCM to provide for electrical, hydraulic, or electrical and hydraulic control of the underwater tree, the adapter having a first mounting portion having a plurality of connectors extending therefrom arranged to connect with the plurality of connectors of the replacement SCM, and a second mounting portion having a plurality of connectors extending therefrom arranged to connect with the plurality of connectors extending from the mounting plate of the SCM mounting structure.

14. A method as defined in claim 13, wherein the first mounting portion comprises a first mounting plate, wherein the second mounting portion comprises a second mounting plate positioned parallel to and spaced apart from the first mounting plate, and wherein a plurality of electrical and hydraulic fluid interconnections extend therebetween.

15. A method as defined in claim 14, further comprising:

positioning a shroud around outer surface portions of the first and the second mounting plates to protect the electrical and hydraulic fluid interconnections.

16. A method as defined in claim 14, wherein the first mounting plate of the adapter has a smaller cross-section than the second mounting plate of the adapter.

17. A method as defined in claim 13, wherein the adapter further comprises a locking shaft extending from the second mounting portion and configured to extend into an orifice in the mounting plate of the SCM mounting structure.

18. a method as defined in claim 17, wherein the replacement SCM includes a locking shaft extending from the base thereof, and wherein the locking shaft of the adapter includes an orifice sized to receive the locking shaft of the replacement SCM.

19. A method as defined in claim 18, wherein the step of attaching the replacement SCM to the SCM mounting structure includes:

inserting the locking shaft of the adapter through an orifice of the in the mounting plate of the SCM mounting structure; and angularly rotating the locking shaft of the replacement SCM.

20. A. method as defined in claim 17, wherein the locking shaft is axially positioned in a center of the replacement SCM along a main longitudinal axis of the replacement SCM when the replacement SCM is operably attached to the adapter.

21. A method as defined in claim 13, wherein the plurality of connectors mounted to the base of the replacement SCM provide electrical, hydraulic fluid and optical connections.

* * * * *